United States Patent [19]

Angevine et al.

[11] 4,419,218

[45] Dec. 6, 1983

[54] CATALYTIC CONVERSION OF SHALE OIL

[75] Inventors: Philip J. Angevine, West Deptford; Günter H. Kühl; Sadi Mizrahi, both of Cherry Hill, all of N.J.

[73] Assignee: Mobil Oil Corporation, New York, N.Y.

[21] Appl. No.: 281,450

[22] Filed: Jul. 8, 1981

[51] Int. Cl.[3] ..... C10G 47/16

[52] U.S. Cl. ..... 208/59; 208/DIG. 2; 208/89; 208/111; 208/120

[58] Field of Search ..... 208/120, 111, 59, 89

[56] References Cited

U.S. PATENT DOCUMENTS

| | | | |
|---|---|---|---|
| 3,322,194 | 5/1967 | Strubhar | 166/159 |
| 3,832,449 | 8/1974 | Rosinski et al. | 208/111 |
| 3,970,544 | 7/1976 | Rosinski et al. | 208/111 |
| 4,057,488 | 11/1977 | Montlaena et al. | 208/89 |
| 4,153,540 | 5/1979 | Gorring et al. | 208/89 |
| 4,210,521 | 7/1980 | Gorring et al. | 208/89 |

*Primary Examiner*—Delbert E. Gantz
*Assistant Examiner*—George E. Schmitkons
*Attorney, Agent, or Firm*—Alexander J. McKillop; Michael G. Gilman; Howard M. Flournoy

[57] ABSTRACT

Zeolite catalysts having a low constraint index maximize conversion of hydrotreated shale oil primarily to the preferred 400–600° F. boiling range distillate.

9 Claims, No Drawings

CATALYTIC CONVERSION OF SHALE OIL

BACKGROUND OF THE INVENTION

1. Field of the Invention

This invention relates to the catalytic conversion of shale oil. More particularly, it relates to such conversion using a zeolite catalyst having a low constraint index.

2. Discussion of the Prior Art

Catalytic reactions involving petroleum feed stocks have been known in the petroleum industry for a long time, e.g., the catalytic conversion of naphtha stocks. U.S. Pat. No. 4,191,638, for example, teaches most naphthas contain large amounts of naphthenes and aromatics and that, while the octane numbers are low, these stocks lend themselves well to catalytic conversion to gasoline stocks. On the other hand, shale oils, which have relatively high concentrations of paraffins and naphthenes, are not desirable as a feed to produce gasoline.

In U.S. Pat. No. 3,322,194, it is disclosed that vast quantities of hydrocarbons are contained in oil shale formations which are found in several parts of the world and particularly in the Piceance Creek Basin of the Green River Formation of Colorado. In these formations, the oil shale is not a true shale nor does it contain oil in the common usage of that term. The oil shale is a fine-grained, compact sedimentary rock which is generally highly laminated in the horizontal by bedding planes. It is more in the nature of marlstone. It contains an organic matter, kerogen, which is an amorphous organic solid. Kerogen, particularly, is defined as an organic, high molecular weight mineraloid of indefinite composition. The kerogen is not soluble in conventional solvents but will decompose by pyrolysis upon being heated to temperatures above 500° F. to provide fluid hydrocarbons commonly termed "shale oil". Generally, the decomposition is undertaken at temperatures about 900° F. However, excessive temperatures are usually avoided in the pyrolysis of kerogen to avoid heat consumption by the decomposition of the mineral carbonate constituents in the oil shale. Thus, oil shale must be heated in a process of pyrolysis, which process is usually termed "retorting", in order to obtain the desired recovery of hydrocarbons. For this purpose, it is necessary to either mine the oil shale and then retort it at the earth's surface, or to retort it in-place.

SUMMARY OF THE INVENTION

In accordance with the invention, there is provided a process for selectively converting a shale oil or heavy shale oil fraction to a fraction containing from about 50 percent to about 95 percent by weight of oil boiling in the 400°–650° F. boiling range, comprising contacting said shale oil with a crystalline alumino-silicate having a silica-to-alumina ratio of greater than 12 and constraint index of from about 0.4 to about 2.5, preferably ZSM-12. In particular, the silica-to-alumina ratio will preferably range from about 40 to 1600 and above, more preferably from about 40 to about 250.

DISCUSSION OF SPECIFIC EMBODIMENTS

In one aspect, the zeolites useful herein may be identified in terms of mole ratios of oxides substantially as follows:

$$\leqq 1.3\ M_{\frac{2}{n}}O:L_2O_3:xTO_2:zH_2O$$

wherein M is a cation, n is the valence of said cation, L is a trivalent metal atom from Groups III through VIII of the Periodic Table or mixtures of such atoms, including, for example, Groups IIIB (e.g., aluminum, gallium, and boron), Group VIA (e.g., chromium) and Group VIII (e.g., iron), T is silicon or germanium, x is greater than 12 and z is 0 to 40.

In a preferred synthesized form, the zeolite has a formula, in terms of mole ratios of oxides, as follows:

$$\leqq 1.3\ M_{\frac{2}{n}}O:Al_2O_3:xSiO_2:zH_2O$$

where M is a mixture of alkali metal cations, especially sodium, and alkylammonium cations, the alkyl groups of which preferably contain from 2 to 5 carbon atoms, and x is greater than 12.

In a more preferred embodiment, the zeolite is ZSM-12, L is aluminum, T is silicon and the silica/alumina ratio is at least 12 and can range up to 4000 or more.

Thus, in general the term "zeolite" herein defines a natural or synthetic porous tectosilicate characterized by having a rigid crystalline framework structure composed of an assembly of silicon atoms and at least a trace amount of a trivalent metal atom, preferably aluminum, but which can also be iron, boron, gallium, chromium, and the like, or mixtures thereof, the silicon atoms and trivalent metal atoms each being surrounded by a tetrahedron of shared oxygen atoms, and a precisely defined pore structure.

The crystalline zeolites utilized herein are more particularly members of a class of zeolitic materials which exhibit unusual properties. Although these zeolites have unusually low alumina contents, i.e. high silica to alumina mole ratios, they are very active even when the silica to alumina mole ratio exceeds 30. The activity is surprising since catalytic activity is generally attributed to framework aluminum atoms and/or cations associated with these aluminum atoms. They retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning carbonaceous deposits with oxygen-containing gas such as air.

The silica to alumina mole ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina mole ratio of at least 12 are useful, it is preferred in some instances to use zeolites having substantially higher silica/alumina ratios, e.g. 1600 and above. In addition, zeolites as otherwise characterized herein but which are substantially free of aluminum, that is zeolites having silica to alumina mole ratios of close to infinity, are found to be useful and even preferable in some instances. Such "high silica" or "highly siliceous"

zeolites are intended to be included within this description.

The zeolites, after activation, acquire an intracrystalline sorption capacity for normal hexane which is less than that for cyclohexane and greater than that for water. This latter property shows that they exhibit "hydrophobic" properties. This hydrophobic character can be used to advantage in some applications.

The zeolites useful herein provide constrained access to certain molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type.

Rather than attempt to judge from crystal structure whether or not a zeolite possesses the necessary constrained access to molecules of larger cross-section than normal paraffins, a simple determination of the "constraint index" as herein defined may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 540° C. for at least 15 minutes. The zeolite is then flushed with helium and the temperature is adjusted between 290° C. and 510° C. to give an overall conversion of between 10 percent and 60 percent. The mixture of hydrocarbons is passed at 1 liquid hourly space velocity (i.e., 1 volume of liquid hydrocarbon per volume of zeolite per hour) over the zeolite with a helium dilution to give a helium to (total) hydrocarbon mole ratio of 4:1. After 20 minutes on stream, a sample of the effluent is taken and analyzed, most conveniently by gas chromatography, to determine the fraction remaining unchanged for each of the two hydrocarbons.

While the above experimental procedure will enable one to achieve the desired overall conversion of 10 to 60 percent for most zeolite samples and represents preferred conditions, it may occasionally be necessary to use somewhat more severe conditions for samples of very low activity, such as those having an exceptionally high silica to alumina mole ratio. In those instances, a temperature of up to about 540° C. and a liquid hourly space velocity of less than one, such as 0.1 or less, can be employed in order to achieve a minimum total conversion of about 10 percent.

The "Constraint Index" is calculated as follows:

$$\text{Constraint Index} = \frac{\log_{10}(\text{fraction of hexane remaining})}{\log_{10}(\text{fraction of 3-methylpentane remaining})}$$

The constraint index approximates the ratio of the cracking rate constants for the two hydrocarbons. Zeolites suitable for the present invention are those having a constraint index of about 0.4 to about 2.5. Constraint index values for some typical materials are:

TABLE 1

| | C.I. |
|---|---|
| ZSM-4 | 0.5 |
| ZSM-12 | 2 |

TABLE 1-continued

| | C.I. |
|---|---|
| Beta | 0.6 |
| H—mordenite | 0.4 |

The above-described constraint index is an important and even critical definition of those zeolites which are useful in the instant invention. The very nature of this parameter and the recited technique by which it is determined, however, admit of the possibility that a given zeolite can be tested under somewhat different conditions and thereby exhibit different constraint indices. Constraint index seems to vary somewhat with severity of operation (conversion) and the presence or absence of binders.

ZSM-12 is described in U.S. Pat. No. 3,832,449. That description, and in particular the X-ray diffraction pattern disclosed therein, is incorporated herein by reference.

The original cations of the useful zeolites can be subsequently replaced, at least in part, by calcination and/or ion exchange with another cation. Thus, the original cations are exchanged into a hydrogen or hydrogen ion precursor form or into a form in which the original cation has been replaced by a metal ion of Groups II through VIII of the Periodic Table. Thus, for example, it is contemplated to exchange the original cations with ammonium ions or with hydronium ions. Catalytically active forms of these would include, in particular hydrogen, rare earth metals, aluminum, manganese and other metals found in Groups I to VIII of the Periodic Table.

It is to be understood that by incorporating by reference the foregoing patent to describe examples of specific members of the novel class with greater particularity, it is intended that identification of the therein disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patent should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The specific zeolites described, when prepared in the presence of organic cations, are substantiallly catalytically inactive. They may be activated by heating in an inert atmosphere at 540° C. for one hour, for example, followed by base exchange with ammonium salts followed by calcination at 540° C. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 540° C. for from about 15 minutes to about 24 hours.

In addition to the hydrogen form, other forms of the zeolite wherein the original alkali metal content has been reduced may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing a particularly desired chemical conversion process, it may be useful to incorporate the above-described crystalline zeolite with a matrix comprising another material resistant to the temperature and other conditions employed in the process. Such matrix material is useful as a binder and imparts greater resistance to the catalyst for the severe temperature, pressure and reactant feed stream velocity conditions encountered in many cracking processes.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from about 1 to about 99 percent by weight and more usually in the range of about 5 to about 80 percent by weight of the dry composite.

As has been stated, the zeolites used in this invention may have the original cations associated therewith wholly or partly replaced by a wide variety of other cations according to techniques well known in the art, as by ion exchange. Typical replacing cations include hydrogen, ammonium, and metal cations including mixtures of the same. Of the replacing cations, particular preference is given to cations of hydrogen, alkali, ammonium, rare earth, aluminum, manganese, magnesium, calcium, zinc, copper, silver, platinum, palladium, nickel and mixtures thereof. The metals may be also added by impregnation.

Typical ion exchange techniques include contacting the particular zeolite with a salt of the desired replacing cation or cations. Although a wide variety of salts can be employed, particular preference is given to chlorides, nitrates and sulfates. Pd and Pt can also be exchanged via their tetrammine complex ions.

Representative ion exchange techniques are disclosed in a wide variety of patents, including U.S. Pat. Nos. 3,140,249; 3,140,251; and 3,140,253.

Shale oil, as has been stated, contains a relatively high concentration of paraffins and naphthenes. For this reason, it is a particularly suitable chargestock for making diesel fuel, jet fuel and light fuel oil, but a poor chargestock for producing acceptable gasoline. Catalysts having a selectivity to 400°–650° F. distillate are, therefore, desirable for shale oil processing. ZSM-12, for example, shows such selectivity due to its low constraint index and converts the 650° F.+ fraction of shale oil without overcracking the 400°–650° F. product to undesirable lighter fractions. High constraint index zeolitic catalysts (e.g., ZSM-5) produce larger quantities of naphtha and light gases than ZSM-12 and are not as suitable for processing shale oil. Other high $SiO_2/Al_2O_3$ ratio zeolites with similar constraint indexes are expected to behave similarly.

The desirable products of shale oil are primarily diesel fuel, jet fuel and light fuel oil. Diesel fuel normally boils between 380° and 650° F. and has a cetane number greater than 40. The cetane number is related to engine performance; paraffinic fuels, such as shale oil distillate, generally have a high cetane number. Light fuel oil is similar in boiling range to diesel fuel but has no cetane requirements. Jet fuel has a higher volatility than light fuel oil (boiling range 300°–500° F.). The process described in this invention does not necessarily produce the finished fuels but maximizes the material in the boiling range suitable for these fuels.

Having described the invention in general terms, following are Example that will provide illustrations thereof.

EXAMPLE

The shale oil used in the example was produced by Occidental Oil's modified in-situ process. Before processing over ZSM-12 this oil was hydrotreated to 340 ppm nitrogen in a fixed-bed reactor containing a commercially available hydrotreating catalyst. Preferred hydrotreating conditions were 2000–2200 psig hydrogen pressure, 750°–775° F., 0.4–0.7 LHSV, and hydrogen circulation of 5000–8000 SCF/B. Broad range of conditions are:

Temperature: 650°–825° F.
Pressure: 500–3000 psig
$H_2$/Oil: 1000–10,000 SCF/B
LHSV: 0.2–2.0

ZSM-12 Crystallization and Preparation of Catalyst

Aluminum nitrate, $Al(NO_3)_3.9H_2O$, 100 g, was dissolved in 10,375 g of water. A 50 percent solution of sodium hydroxide, 625 g, and 1530 g of a 50 percent solution of methyltriethyl-ammonium chloride were added. Finally, 3000 g of Hi-Sil (precipitated silica, 90 percent solids) was added. The reaction mixture was heated at 50° C. for 24 hours, then at 160° C. for 48 hours. The crystalline material was filtered and washed with water until chloride-free. Finally, it was dried at 120° C.

The zeolite was mixed with Kaiser alumina and water. The mixture was extruded to yield a 1/16" dia. extrudate containing 65 percent ZSM-12 and 35 percent alumina. The extrudate was dried, then calcined in flowing nitrogen at a heating rate of 3° C./min. to 540° C., held at this temperature for 3 hours, then cooled to ambient temperature and treated with gaseous ammonia.

The sodium contained in the ZSM-12 was removed by ion-exchange of the calcined and ammonia-treated extrudate with ammonium chloride. The material was washed with water until free of chloride. The product contained 0.01 percent Na. Prior to the use as catalyst, the extrudate was calcined for 3 hours at 540° C. in air.

The properties of the chargestock and catalyst used in this Example are shown in Tables 2 and 3, respectively.

The hydrotreated shale oil was hydroprocessed over the above-described ZSM-12 under conditions shown in Table 4.

For comparison the yields obtained over ZSM-12 are listed along with the yields over NaZSM-5 under the same conditions (Table 4). Even though NaZSM-5 is more active for conversion of the 650° F.+ material by about 25° F., the selectivity of ZSM-12 towards the 400°-650° F. distillate combined with low light gas and naphtha yields make this catalyst more desirable for shale oil processing. Results show that, when the ratio of 400°-650° F. yield to 400° F.− yield as a function of 650° F.+ conversion is compared, at the same conversion level a higher distillate yield is obtaind over ZSM-12. This selectivity difference would be higher if 650° F.+ hydrotreated shale oil were processed instead of whole range material.

Shale oil has to be hydrotreated before going over the ZSM-12 catalyst especially since the low constraint index makes the catalyst pores more accessible to basic nitrogen compounds. Although whole range hydrotreated shale oil can be processed over this catalyst, one preferred configuration would process the 650° F.+ material to maximize 400°-650° F. boiling range product.

TABLE 2

Properties of Hydrotreated Shale Oil[1] Used in the Experiments

| | |
|---|---|
| Gravity, °API | 36.1 |
| Pour Point, °F. | 55 |
| Hydrogen, Wt. Percent | 13.81 |
| Nitrogen, ppm | 340 |
| Sulfur, Wt. Percent | 0.133 |
| Distillation (D2887) Wt. Percent | |
| I-400° F. | 13.6 |
| 400-650° F. | 50.6 |
| 650-850° F. | 26.9 |
| 850° F.+ | 8.9 |

[1]Occidental in-situ shale oil

TABLE 3

Properties of the ZSM-12 Catalyst

| | |
|---|---|
| Zeolite (HZSM-12), Wt. Percent | 65 |
| Binder $Al_2O_3$, Wt. Percent | 35 |
| Zeolite properties: | |
| $SiO_2/Al_2O_3$ mol ratio | 123 |
| Alpha Activity | 81 |
| Extrudate Alpha Activity | 71 |

TABLE 4

Product Yields[1] From Hydrotreated Shale Oil Over HZSM-12 and NaZSM-5

| | Catalyst: | | | |
|---|---|---|---|---|
| | HZSM-12 | | NaZSM-5 | |
| Reactor Temp., °F. | 750 | 775 | 750 | 775 |
| Yield Wt. Percent | | | | |
| $C_1$-$C_3$ | 0.17 | 0.66 | 1.1 | 2.49 |
| $C_4$ | 0.19 | 0.68 | 2.1 | 3.80 |
| $C_5$ | 0.27 | 0.72 | 2.5 | 3.45 |
| $C_6$-400° F. | 12.0 | 15.6 | 18.9 | 22.6 |
| 400-650° F. | 52.5 | 53.8 | 48.1 | 45.1 |
| 650-850° F. | 26.5 | 23.0 | 25.9 | 22.0 |
| 850° F.+ | 8.0 | 5.4 | 1.41 | 0.6 |
| $H_2$ Cons., scf/b | −4 | ~0 | 9 | 83 |
| Pour Point, °F. | 80 | 75 | <−65 | <−65 |

[1]0.5 LHSV; 2000 psig; 5000 scf of $H_2$ per bbl.

We claim:

1. A process for selectively converting a previously hydrotreated shale oil to a fraction primarily in the 400°-650° F. boiling range, comprising contacting said shale oil with a ZSM-12 crystalline aluminosilicate zeolite having a silica-to-alumina ratio greater than about 12 said shale oil having been previously hydrotreated at a temperature of about 650°-850° F., a pressure of about 500 to 3000 psig, and hydrogen/oil ratio of about 1,000-10,000 SCF/B and an LHSV of about 0.2-2.95 and thereafter hydroprocessing under shale oil conversion conditions sufficient to convert from at least about 50 to about 95% of the unconverted treated shale oil present based on the weight of the oil to said 400°-650° F. fraction.

2. The process of claim 1 wherein the treated shale oil is hydroprocessed at a temperature of from about 750°-775° F., a pressure of about 2000 psig, a LVHS of about 0.5 and about 5000 SCF/B hydrogen.

3. The process of claim 1 wherein the silica-to-alumina ratio is about 40 to 1600.

4. The process of claim 3 wherein the silica-to-alumina ratio is about 40 to about 250.

5. The process of claim 4 wherein the silica-to-alumina ratio is about 120 to about 125.

6. The process of claim 1 wherein the $SiO_2/Al_2O_3$ is above 1600.

7. The process of claim 1 wherein the original cations have been replaced by hydrogen, ammonium ions or by metal ions of Groups I to VIII of the Periodic Table.

8. The process of claim 7 wherein the zeolite, following exchange, is calcined.

9. The process of claim 8 wherein the zeolite is in the hydrogen form.

* * * * *

UNITED STATES PATENT AND TRADEMARK OFFICE

CERTIFICATE OF CORRECTION

PATENT NO. : 4,419,218

DATED : December 6, 1983

INVENTOR(S) : Philip J. Angevine et al.

It is certified that error appears in the above—identified patent and that said Letters Patent is hereby corrected as shown below:

Column 8, line 26 of claim 1, "850°F" should be --825°F--.

Signed and Sealed this

*Seventeenth* Day of *July 1984*

[SEAL]

*Attest:*

GERALD J. MOSSINGHOFF

*Attesting Officer*

*Commissioner of Patents and Trademarks*